US010094543B2

(12) United States Patent
Xu

(10) Patent No.: US 10,094,543 B2
(45) Date of Patent: Oct. 9, 2018

(54) OUTDOOR LIGHTING SYSTEM AND SPIKE LIGHT FOR THE SAME

(71) Applicant: DONGGUAN JIASHENG LIGHTING TECHNOLOGY CO., LTD., Dongguan, Guangdong Province (CN)

(72) Inventor: Shuisheng Xu, Dongguan (CN)

(73) Assignee: Dongguan Jiasheng Lighting Technology Co., Ltd., Dongguan (CN)

( * ) Notice: Subject to any disclaimer, the term of this patent is extended or adjusted under 35 U.S.C. 154(b) by 155 days.

(21) Appl. No.: 15/349,213

(22) Filed: Nov. 11, 2016

(65) Prior Publication Data

US 2017/0130943 A1 May 11, 2017

(30) Foreign Application Priority Data

Nov. 11, 2015 (CN) ..... 2015 2 0895661 U

(51) Int. Cl.

| | |
|---|---|
| ***F21V 21/14*** | (2006.01) |
| ***F21V 19/00*** | (2006.01) |
| ***F21V 21/08*** | (2006.01) |
| ***F21V 21/10*** | (2006.01) |
| ***F21V 21/34*** | (2006.01) |

(Continued)

(52) U.S. Cl.

CPC ..... *F21V 21/14* (2013.01); *F21V 19/0005* (2013.01); *F21V 21/002* (2013.01); *F21V 21/0824* (2013.01); *F21V 21/10* (2013.01); *F21V 21/34* (2013.01); *F21V 23/002* (2013.01); *F21V 23/0471* (2013.01); *F21V 23/06* (2013.01); *F21V 21/30* (2013.01); *F21W 2111/023* (2013.01); *F21W 2131/10* (2013.01); *F21W 2131/109* (2013.01)

(58) Field of Classification Search

CPC ..... F21V 21/14; F21V 21/34; F21V 21/002; F21V 21/0824; F21V 21/10; F21V 23/002; F21W 2131/10

See application file for complete search history.

(56) References Cited

U.S. PATENT DOCUMENTS

| | | | | |
|---|---|---|---|---|
| 5,217,298 A * | 6/1993 | Jackson | ..... | F21S 6/006 362/249.01 |
| 6,540,549 B2 * | 4/2003 | Rupert | ..... | H01R 13/64 439/215 |

(Continued)

*Primary Examiner* — Karabi Guharay

(74) *Attorney, Agent, or Firm* — Alan D. Kamrath; Kamrath IP Lawfirm, P.A.

(57) ABSTRACT

Disclosed are a spike light and an outdoor lighting system. The outdoor lighting system comprises a power module, a relay module, spike lights and a PIR detection module, wherein the relay module receives a signal sent by the PIR detection module and transmits the signal to the power module; the power module receives and process the signal transmitted by the relay module, and meanwhile controls the on/off of the spike lights; the spike lights comprise a number of spike lights, each of which includes lighting lamp devices and a post, the lighting lamp devices being mounted on the post, electric wires being provided within the post; and, each of the lighting lamp devices comprises a lamp and a socket assembly, a pin electrically connected to the lighting lamp device being provided on the socket assembly, the pin being inserted into the post and puncturing the electric wires within the post.

15 Claims, 4 Drawing Sheets

(51) Int. Cl.

| | |
|---|---|
| ***F21V 23/00*** | (2015.01) |
| ***F21V 23/04*** | (2006.01) |
| ***F21V 23/06*** | (2006.01) |
| ***F21V 21/002*** | (2006.01) |
| *F21W 131/10* | (2006.01) |
| *F21V 21/30* | (2006.01) |
| *F21W 111/023* | (2006.01) |
| *F21W 131/109* | (2006.01) |

(56) References Cited

U.S. PATENT DOCUMENTS 8,827,728 B1 * 9/2014 Lin ..... F21V 21/002
439/168
9,752,763 B2 * 9/2017 Lin ..... F21V 23/002

* cited by examiner

OUTDOOR LIGHTING SYSTEM AND SPIKE LIGHT FOR THE SAME

FIELD OF THE INVENTION

The present invention relates to lighting lamps and lighting systems and in particular to an outdoor lighting system and a spike light for the same.

BACKGROUND OF THE INVENTION

As landscape lights, spike lights are lights indispensable for outdoor decoration, and widely applied in parks, plazas, communities, streets, courtyard and other places. In order to adjust the height, existing spike lights are formed by generally connecting and muff-coupling segmented hollow columns and then connecting them to spikes. The segmented combination of such spike lights wastes the material and space, and it is likely to cause the missing of assembled parts, so that it is convenient for users.

In addition, traditional spike lights can irradiate in only one direction, but there will be a shaded area on the side opposite to the lamps. The lighting width is insufficient, and good irradiation effects cannot be realized. In order to solve the problem of insufficient lighting width, some of spike lights are provided with a plurality of lamps facing various directions at a same position on a post. However, as there are electric wires for each lamp, it is likely to result in the disorder of the electric wires, and the height cannot be adjusted so that the flexibility is poor.

SUMMARY OF THE INVENTION

Based on this, in view of the deficiencies in the prior art, it is necessary to provide a spike light which may realize the arbitrary adjustment of height and direction of lamps, may be provided with a plurality of lamps simultaneously for meeting the requirements of irradiation in different fields and which has neat appearance and a single electric wire on the ground, and an outdoor lighting system which has the functions of intelligent light control, power saving and safety protection.

A spike light is provided, including a number of lighting lamp devices, a post and a pedestal, wherein the post is arranged on the pedestal, the lighting lamp devices are arranged on the post, and the direction and height of the lighting lamp devices can be adjusted as required; a guide rail is provided on the post, and a number of electric wires in a same circuit are provided within the post; each of the lighting lamp devices includes a lamp and a socket assembly, the socket assembly including a plug having a pin at one end thereof and a jack at the other end thereof, the plug being snapped onto the post in a direction perpendicular to the post, the pin being inserted into the guide rail and puncturing the electric wires within the post; and, an electric wire is provided on the lamp, and one end, away from the lamp, of the electric wire for the lamp is inserted into the jack and electrically connected to the pin.

Further, the plug includes two first limiting portions, with a spacing between the two first limiting portions being adapted to the size of the post; the two first limiting portions are snapped onto two opposite outer sides of the post; and the pin is arranged between the two limiting portions.

Further, the socket assembly further includes a housing and a snap ring, which are mounted at two ends of the plug, respectively; the plug is fixed on the post; and the housing, the post and the snap ring form a closed space in which the plug is encapsulated.

Further, external threads are convexly provided on the plug, and internal threads adapted to the external threads are concavely provided inside the housing and the snap ring.

Further, the post is an aluminum-based rectangular rod.

Further, one end, away from the lamp, of the electric wire for the lamp is a skinned conductive core wire end.

Further, each of the lighting lamp devices further includes a connecting rod, two ends of which are connected to the socket assembly and the lamp, respectively; and a rotary holder, on which the lamp is fixed, is provided at an end of the connecting rod connected to the lamp, and the rotary holder drives the lamp to freely rotate.

Further, the pedestal includes a spike portion, a pedal portion and a guide portion, the spike portion and the guide portion being integrally connected to two ends of the pedal portion, respectively.

Further, the spike portion has a cross-shaped cross-section, and an arrow tip is provided at the tail end of the spike.

Further, a bulge horizontally extending outward is convexly provided on a side face of the pedal.

Further, a mounting hole vertically running through a groove of the pedal portion is formed on an upper end face of the guide portion, and the post is mounted inside the groove.

Further, a notch communicated with the groove is formed on one side of the spike portion below the pedal portion, and the electric wires pass through the notch and extend into the post.

An outdoor lighting system is provided, including a power module, a receiver, a spike light and a PIR detection module, wherein the power module supplies power to the spike light, and the receiver receives a signal transmitted by the PIR detection module and controls the power module; the spike light includes a number of lighting lamp devices, a post and a pedestal; the post is arranged on the pedestal, the lighting lamp devices are arranged on the post, and the direction and height of the lighting lamp devices can be adjusted as required; a guide rail is provided on the post, and a number of electric wires in a same circuit are provided within the post; each of the lighting lamp devices includes a lamp and a socket assembly, the socket assembly including a plug having a pin at one end thereof and a jack at the other end thereof, the plug being snapped onto the post in a direction perpendicular to the post, the pin being inserted into the guide rail and puncturing the electric wires within the post; and, an electric wire is provided on the lamp, and one end, away from the lamp, of the electric wire for the lamp is inserted into the jack and electrically connected to the pin.

Further, the plug includes two first limiting portions, with a spacing between the two first limiting portions being adapted to the size of the post; the two first limiting portions are snapped onto two opposite outer sides of the post; and the pin is arranged between the two limiting portions.

Further, the PIR detection module is provided with a number of PIR detectors; the PIR detection device includes a PIR detector, a socket assembly, a post and a pedestal; and the post is mounted on the pedestal, the socket assembly is mounted on the post, and the PIR detector is mounted on the socket assembly.

Compared with the prior art, in the outdoor lighting system provided by the present invention, by providing a PIR detection module, the ON/OFF of a plurality of spike lights in a same circuit may be controlled by mounting the PIR detection module at any position on the same circuit, so that the functions of intelligent light control, power saving and safety protection are realized. With regard to the spike light, by providing the post and the socket assembly, a plurality of lighting lamp devices may be quickly mounted on a same post and irradiate in different directions and fields; and, the appearance is neat, and there is a single electric wire on the ground. The height and direction of the lighting lamp devices may be adjusted arbitrarily as required in order to meet the requirements of irradiating different fields by light. Moreover, the spike light is easy to mount, low in cost and beautiful in appearance.

DETAILED DESCRIPTION OF THE PREFERRED EMBODIMENTS

To make the objectives, technical solutions and advantages of the present invention understood clearer, the present invention will be further described below in details with reference to the accompanying drawings.

Figure 1:
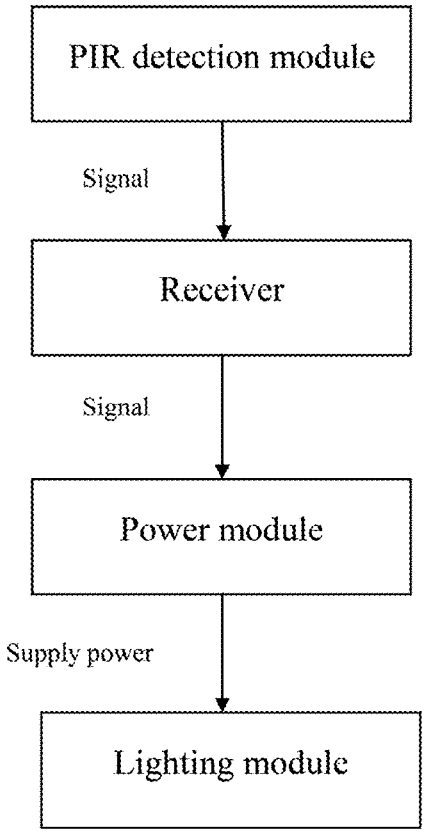
FIG. 1 is a schematic modular diagram of an outdoor lighting system according to the present invention.
Figure 2:
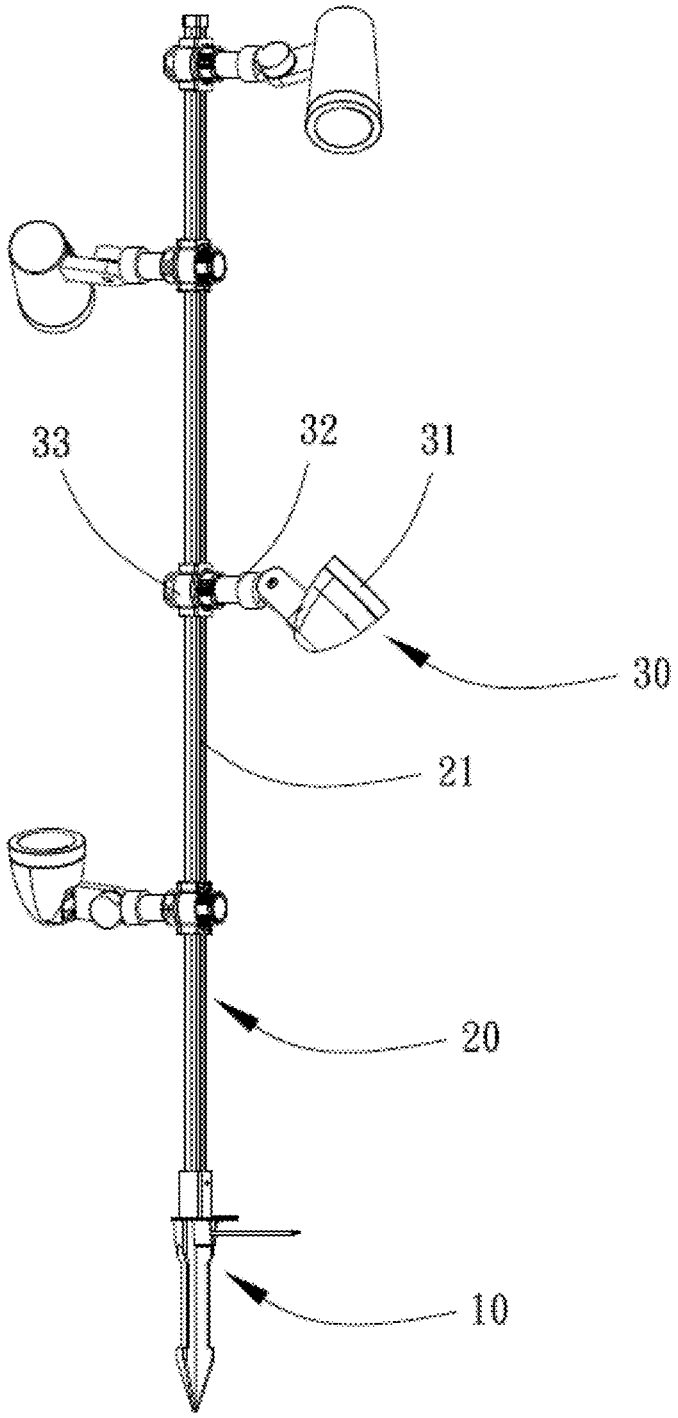
FIG. 2 is a stereoscopic diagram of a spike light according to the present invention.
Figure 3:
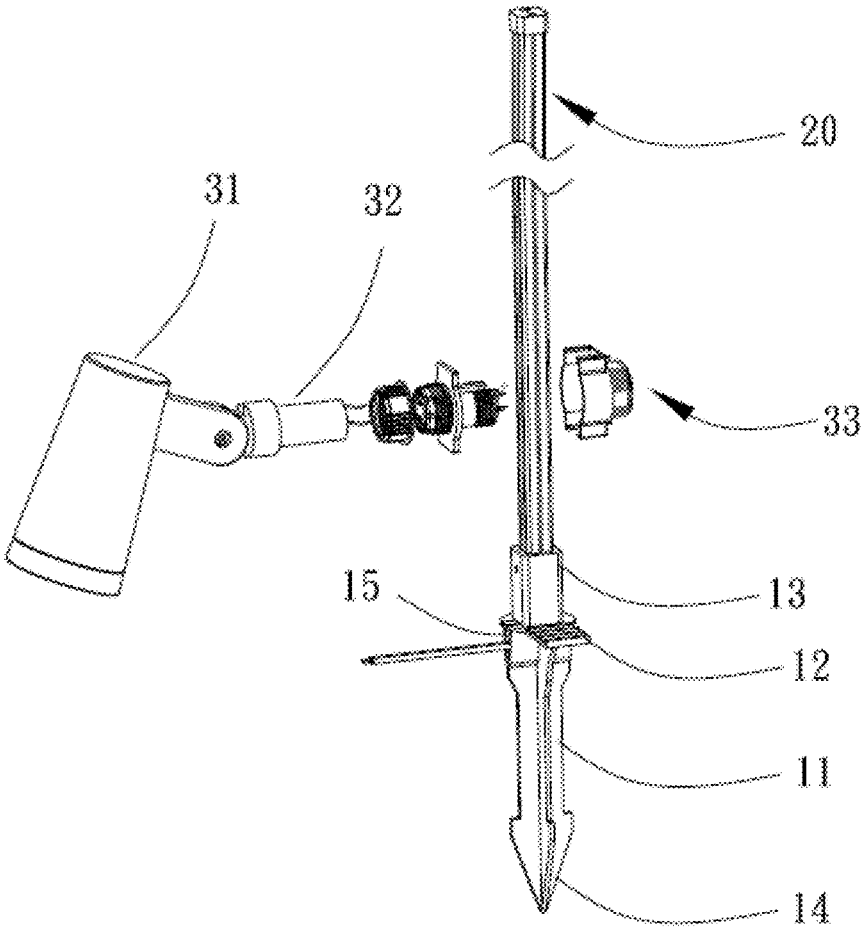
FIG. 3 is an exploded view of the spike light of FIG. 2.
Figure 4:
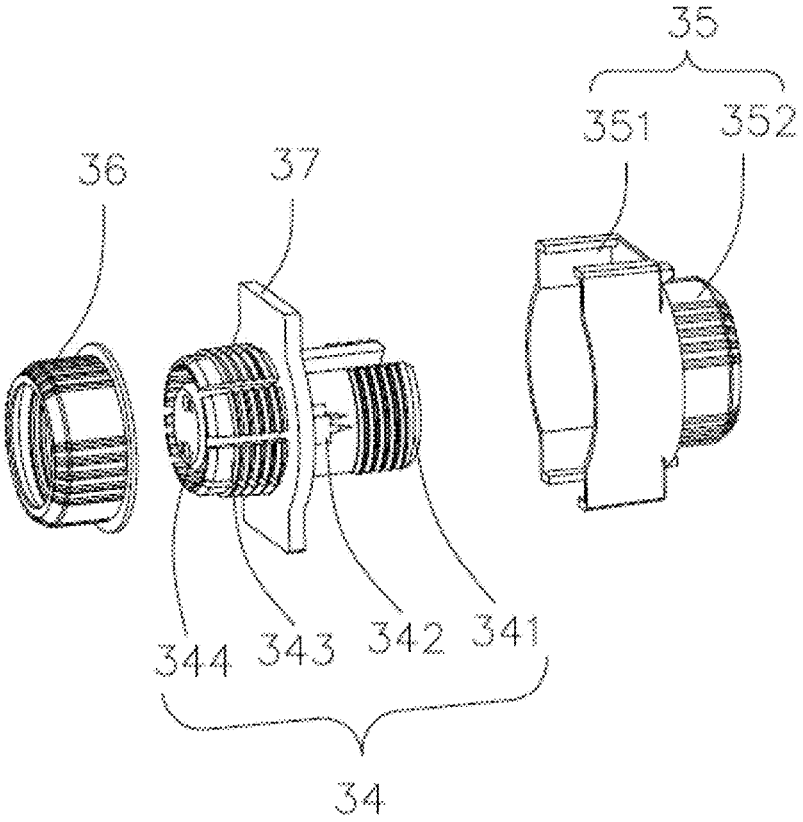
FIG. 4 is an exploded view of a socket assembly of the spike light of FIG. 2.

As shown in FIGS. 1-4, the present invention provides an outdoor lighting system. The outdoor lighting system is arranged in a courtyard, and has the functions of illumination and safety protection at night. The outdoor lighting system includes a power module, a receiver, spike lights and a PIR detection module. The power module supplies power to the spike lights. The receiver receives a signal transmitted by the PIR detection module, and controls the power supply and interruption of the power module according to the signal transmitted by the PIR detection module.

The power module supplies power to the spike lights, and the PIR detection module may automatically detect passing persons and animals. When the PIR detection module detects that a person or an animal is passing, the PIR detection module transmits a signal to the receiver. Then, the receiver receives the signal transmitted by the PIR detection module and activates the power module to lighten the spike lights, so that the functions of illumination and safety protection at night are realized. When the PIR detection module detects that the person or animal disappears, the receiver receives a signal transmitted by the PIR detection module, and then powers off the power module so as to turn off the spike lights. In this way, the purpose of saving power is achieved.

Each of the spike lights includes a number of lighting lamp device 30, a post 20 and a pedestal 10. The pedestal 10 is embedded into the ground or a desired position. The post 20 is arranged on the pedestal 10, and the lighting lamp device 30 is mounted on the post 20. The height and direction of the lighting lamp devices 30 may be adjusted as required.

The pedestal 10 includes a tip insert portion 11, a pedestal portion 12 and a guide portion 13. The tip insert portion 11 and the guide portion 13 are integrally connected to two ends of the pedal portion 12, respectively. The tip insert portion 11 has a cross-shaped cross-section, so that the pedestal 10 is more stable after being inserted into the ground. An arrow tip 14 is provided at the tail end of the tip insert portion 11, so that it is convenient for insertion into the ground. A bulge horizontally extending outward is convexly provided on a side face of the pedal portion 12. A user puts a foot on the pedal portion 12 so that it is convenient to insert the tip insert portion 11 into the ground. A groove (not shown) vertically running through the pedal portion is formed on an upper end face of the guide portion 13, the post 20 is mounted inside the groove, and a notch 15 communicated with the groove is formed on one side of the tip insert portion 11.

The post 20 is an aluminum-based rectangular rod, and a guide rail 21 is convexly provided on an outer side face of the post 20 in an extension direction of the post 20. Electric wires are provided within the post 20. The electric wires pass through the notch 15 on one side of the tip insert portion 11 and then extend into the post 20.

Each of the lighting lamp devices 30 includes a lamp 31, a connecting rod 32 and a socket assembly 33. The lamp 31 and the socket assembly 33 are connected to two ends of the connecting rod 32, respectively. The socket assembly 33 is mounted on the post 32, and the lamp 31 may be arbitrarily rotated as required. A rotary head (not shown) is provided at one end of the connecting rod 31 connected to the lamp 31, and may rotate by 360 degrees. The lamp 31 is mounted on the rotary head, and the rotary head drives the lamp 31 to freely rotate. The lamp 31 is provided with an electric wire. One end, away from the lamp 31, of the electric wire is a skinned conductive core wire end so that it is convenient for grafting connection and powering-on. The electric wire for the lamp 31 passes through the connecting rod 32, extends out from the connecting rod 32 and is inserted into the socket assembly 33.

The socket assembly 33 includes a plug 34, a housing 35 and a snap ring 36. A baffle 37 is provided in the middle of the plug 34. The plug 34 includes two first limiting portions 341, a second limiting portion 343, a pin 342 arranged between the first limiting portions 341, and a raised portion 344 arranged in the second limiting portion 343. A spacing between the two first limiting portions 341 is adapted to the size of the post 20, and the two first limiting portions 341 are snapped to two opposite outer sides of the post 20. The pin 342 is embedded into the guide rail 21, and punctures the electric wires within the post 20. Mutually engaged external threads are provided on the two first limiting portions 341. The housing 35 includes a housing portion 351 and a cover portion 352. Internal threads adapted to the external threads of the first limiting portions 341 are provided inside the cover portion 352. The housing portion 351 is mounted and sheathed on the first limiting portions 341 and abuts against the baffle 37. The cover portion 352 is in threaded connection to the first limiting portions 341 and abuts against the housing portion 351.

A number of grooves extending from an end portion to the baffle 37 are uniformly formed on the second limiting portion 343. An annular groove is formed between the second limiting portion 343 and the raised portion 344, and the connecting rod 32 is inserted inside the annular groove. A jack is provided on the raised portion 344, and a naked wire end of the electric wire for the lamp 31 is inserted into the jack and electrically connected to the pin 341, so that the electrical connection of the lamp 31 and the electric wires within the post 20 is realized. Internal threads adapted to the external threads on the second limiting portion 343 are provided inside the snap ring 36. The snap ring 36 is in threaded connection to the second limiting portion 343, and the connecting rod 32 is fixed inside the second limiting portion 343. The housing 35, the post 32 and the snap ring 36 form a closed space in which the plug 34 is encapsulated, thereby preventing rain or exposure to the sun from affecting the use of the plug 34.

The PIR detection module is provided thereon with a number of PIR detection devices. Each of the PIR detection devices includes a PIR detector, a socket assembly 33, a post 32 and a pedestal 31. The PIR detector is mounted on the post 32 through the socket assembly 33.

In conclusion, with regard to the outdoor lighting system provided by the present invention, by providing a PIR detection module, the ON/OFF of a plurality of spike lights in a same circuit may be controlled by mounting the PIR detection module at any position on the same circuit, so that the functions of intelligent light control, power saving and safety protection are realized. With regard to the spike light, by providing the post 32 and the socket assembly 33, a plurality of lighting lamp devices 30 may be quickly mounted on a same post 32 and irradiate in different directions and fields; and the direction and height of the lighting lamp devices 30 can be adjusted as required in order to meet the requirements of irradiating different fields by light. Moreover, the spike light is easy to mount, low in cost and beautiful in appearance.

The foregoing embodiment is merely an implementation of the present invention. The description of the foregoing embodiment is specific and detailed, but it shall not be interpreted as limiting the patent scope of the present invention. It should be pointed out that, a person of ordinary skill in the art may make some variations and improvements without departing from the concept of the present invention, and these variations and improvements shall fall into the protection scope of the present invention. Therefore, the protection scope of the present invention patent shall be subject to the appended claims.

What is claimed is:

1. A spike light, comprising a number of lighting lamp devices, a post and a pedestal, wherein the post is arranged on the pedestal, the lighting lamp devices are arranged on the post, and the direction and height of the lighting lamp devices can be adjusted as required; a guide rail is provided on the post, and a number of electric wires in a same circuit are provided within the post; each of the lighting lamp devices comprises a lamp and a socket assembly, the socket assembly comprising a plug having a pin at one end thereof and a jack at the other end thereof, the plug being snapped onto the post in a direction perpendicular to the post, the pin being inserted into the guide rail and puncturing the electric wires within the post; and, an electric wire is provided on the lamp, and one end, away from the lamp, of the electric wire for the lamp is inserted into the jack and electrically connected to the pin.

2. The spike light according to claim 1, wherein the plug comprises two first limiting portions, with a spacing between the two first limiting portions being adapted to the size of the post; the two first limiting portions are snapped onto two opposite outer sides of the post; and the pin is arranged between the two limiting portions.

3. The spike light according to claim 1, wherein the socket assembly further comprises a housing and a snap ring, which are mounted at two ends of the plug, respectively; the plug is fixed on the post; and the housing, the post and the snap ring form a closed space in which the plug is encapsulated.

4. The spike light according to claim 3, wherein external threads are convexly provided on the plug, and internal threads adapted to the external threads are concavely provided inside the housing and the snap ring.

5. The spike light according to claim 1, wherein the post is an aluminum-based rectangular rod.

6. The spike light according to claim 1, wherein one end, away from the lamp, of the electric wire for the lamp is a skinned conductive core wire end.

7. The spike light according to claim 1, wherein each of the lighting lamp devices further comprises a connecting rod, two ends of which are connected to the socket assembly and the lamp, respectively; and a rotary holder, on which the lamp is fixed, is provided at an end of the connecting rod connected to the lamp, and the rotary holder drives the lamp to freely rotate.

8. The spike light according to claim 1, wherein the pedestal comprises a spike portion, a pedal portion and a guide portion, the spike portion and the guide portion being integrally connected to two ends of the pedal portion, respectively.

9. The spike light according to claim 7, wherein the spike portion has a cross-shaped cross-section, and an arrow tip is provided at the tail end of the spike.

10. The spike light according to claim 7, wherein a bulge horizontally extending outward is convexly provided on a side face of the pedal.

11. The spike light according to claim 7, wherein a mounting hole vertically running through a groove of the pedal portion is formed on an upper end face of the guide portion, and the post is mounted inside the groove.

12. The spike light according to claim 7, wherein a notch communicated with the groove is formed on one side of the spike portion below the pedal portion, and the electric wires pass through the notch and extend into the post.

13. An outdoor lighting system, comprising a power module, a receiver, a spike light and a PIR detection module, wherein the power module supplies power to the spike light, and the receiver receives a signal transmitted by the PIR detection module and controls the power module; the spike light comprises a number of lighting lamp devices, a post and a pedestal; the post is arranged on the pedestal, the lighting lamp devices are arranged on the post, and the direction and height of the lighting lamp devices can be adjusted as required; a guide rail is provided on the post, and a number of electric wires in a same circuit are provided within the post; each of the lighting lamp devices comprises a lamp and a socket assembly, the socket assembly comprising a plug having a pin at one end thereof and a jack at the other end thereof, the plug being snapped onto the post in a direction perpendicular to the post, the pin being inserted into the guide rail and puncturing the electric wires within the post; and, an electric wire is provided on the lamp, and one end, away from the lamp, of the electric wire for the lamp is inserted into the jack and electrically connected to the pin.

14. The outdoor lighting system according to claim 13, wherein the plug comprises two first limiting portions, with a spacing between the two first limiting portions being adapted to the size of the post; the two first limiting portions are snapped onto two opposite outer sides of the post; and the pin is arranged between the two limiting portions.

15. The outdoor lighting system according to claim 13, wherein the PIR detection module is provided with a number of PIR detectors; the PIR detection device comprises a PIR detector, a socket assembly, a post and a pedestal; and the post is mounted on the pedestal, the socket assembly is mounted on the post, and the PIR detector is mounted on the socket assembly.

* * * * *